US006615528B1

(12) United States Patent
Lindskog et al.

(10) Patent No.: US 6,615,528 B1
(45) Date of Patent: Sep. 9, 2003

(54) METHOD AND ARRANGEMENT RELATING TO A WEAPON WITH A BREECHBLOCK

(75) Inventors: Magnus Lindskog, Skellefteå (SE); Kjell Lindskog, Skellefteå (SE)

(73) Assignee: SQS Security Qube System AB, Skelleftea (SE)

( * ) Notice: Subject to any disclaimer, the term of this patent is extended or adjusted under 35 U.S.C. 154(b) by 0 days.

(21) Appl. No.: 09/662,408

(22) Filed: Sep. 14, 2000

Related U.S. Application Data

(63) Continuation-in-part of application No. PCT/SE99/00378, filed on Mar. 11, 1999.

(30) Foreign Application Priority Data

Mar. 15, 1998 (SE) ..... 9800852

(51) Int. Cl.[7] ..... F41A 17/00
(52) U.S. Cl. ..... 42/70.01
(58) Field of Search ..... 42/70.01, 70.02, 42/70.11

(56) References Cited

U.S. PATENT DOCUMENTS 5,062,233 A * 11/1991 Brown ..... 42/70.11
5,309,842 A * 5/1994 Matysik et al. ..... 102/430
6,148,557 A * 11/2000 Lindskog et al. ..... 42/70.01

FOREIGN PATENT DOCUMENTS

| | | |
|---|---|---|
| SE | 503762 | 8/1996 |
| SE | 506749 | 2/1998 |
| SE | 506750 | 2/1998 |
| WO | 9628704 | 9/1996 |
| WO | 9801715 | 1/1998 |
| WO | 9801716 | 1/1998 |

* cited by examiner

*Primary Examiner*—Stephen M. Johnson
(74) *Attorney, Agent, or Firm*—Nils H. Ljungman & Associates

(57) ABSTRACT

The invention relates to an arrangement and to a method for rendering useless a weapon (100) that includes a breechblock, in the event of an unauthorized appropriation of the weapon. The arrangement (1) includes an expander (10) which has a cavity (13) or a recess and which is intended for insertion into the box (101) accommodating the breechblock of the weapon. An explosive substance (43) is disposed in the expander cavity (13) or recess. The explosive substance (43) is fired in response to an alarm being triggered, therewith deforming the breechblock accommodating space (101).

16 Claims, 3 Drawing Sheets

METHOD AND ARRANGEMENT RELATING TO A WEAPON WITH A BREECHBLOCK

CONTINUING APPLICATION DATA

This application is a Continuation-In-Part application of International Patent Application No. PCT/SE99/00378, filed on Mar. 11, 1999, which claims priority from Swedish Patent Application No. 9800852-7, filed on Mar. 15, 1998. International Patent Application No. PCT/SE99/00378 was pending as of the filing date of this application. The United States was an elected state in International Patent Application No. PCT/SE99/00378.

BACKGROUND OF THE INVENTION

The present invention relates to an arrangement and to a method pertaining to a breechblock-equipped weapon such as to render the weapon unusable in the event of unauthorized appropriation.

OBJECT OF THE INVENTION

An object of the present invention is to provide an arrangement and a method by means of which a weapon will be destroyed in conjunction with unauthorized handling of the weapon. This object is achieved with the arrangement and the method having the characteristic features set forth herein below.

SUMMARY OF THE INVENTION

The inventive arrangement assists in making the theft of such weapons uninteresting, by virtue of the fact that the weapon will be damaged to such an extent as to make repair of the weapon extremely difficult and complicated to carry out.

The arrangement can be combined with many different types of alarm systems and devices which generate an alarm signal that activates the inventive arrangement so as to destroy the weapon.

The inventive arrangement has both technical and economical advantages.

BRIEF DESCRIPTION OF THE DRAWINGS

The invention will now be described in more detail with reference to exemplifying embodiments thereof and also with reference to the accompanying drawings.

DESCRIPTION OF THE PREFERRED EMBODIMENT

Figure 1:
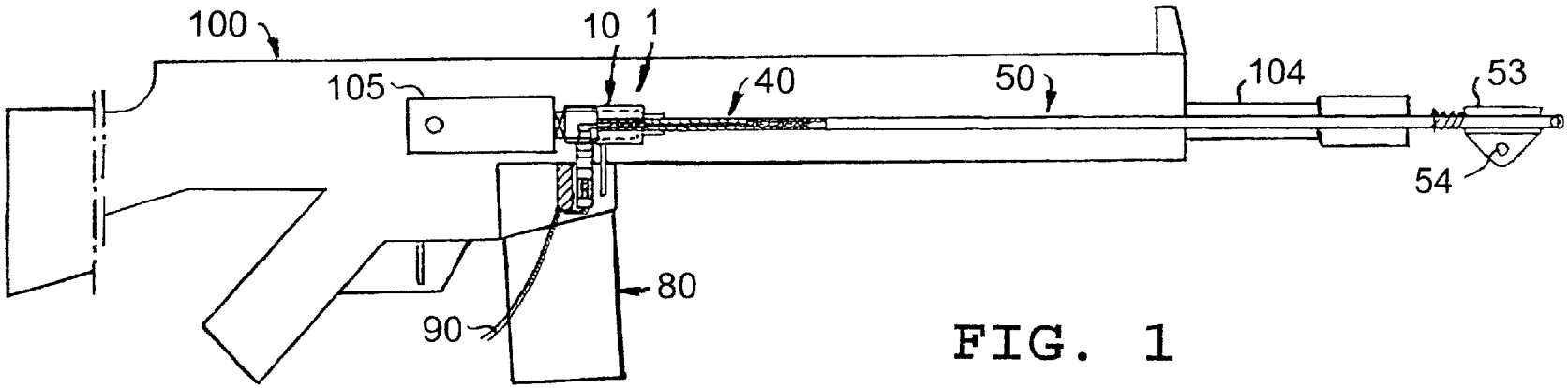
FIG. 1 is a schematic illustration of a weapon provided with an inventive arrangement.

The inventive arrangement 1 includes an expander 10 which is designed to fit in a front part of a so-called breechblock box 101 of a weapon 100. The expander 10 has a front sleeve-part 11 which is designed to fit snugly in the chamber 102 of the weapon. The expander 10 also includes a rear sleeve 12 that has a cavity 13 which communicates with a cavity 14 in the front sleeve 11. The front sleeve 11 has a front opening 15 and the rear sleeve 12 has a rear opening 16. The rear end of the sleeve 12 includes a radial hole 17 for accommodating a so-called detonator or percussion cap 30. The rear sleeve 12 carries an externally arranged guide pin 18 which forces the expander 10 to its correct position of rotation when said expander is positioned in its intended place in the breechblock box 101 of the weapon. The guide pin 18 is guided by the magazine holder 103 of said weapon and also functions as a handle when inserting the expander 10 into the weapon and when removing said expander 10 therefrom.

The expander 10 also includes an end plug 20 which is screwed into the rear part of the sleeve 12. The end plug 20 has an external thread 21 which mates with an internal thread 19 on the sleeve 12. The end plug 20 has a square screw head 22, by means of which the plug 20 can be screwed firmly into the sleeve 12. The end plug 20 also includes an air passageway 23 for communication between the hole 17 and the cavity/space 13 in said sleeve 12, and for accommodating the detonator 30. When required, the air passageway 23 is filled with explosive, so as to ensure that a fully effective explosion will take place.

Figure 2:
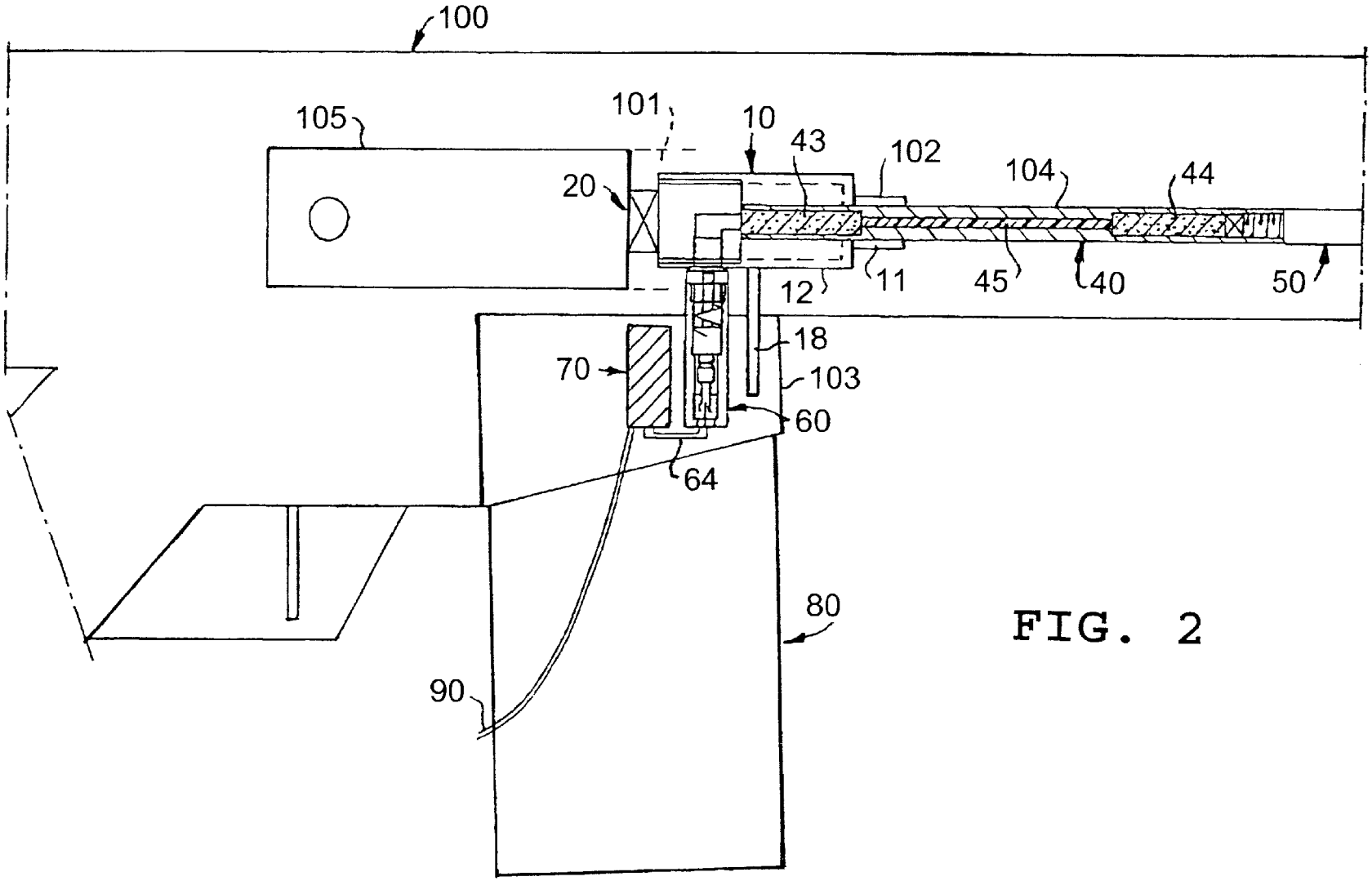
FIG. 2 is a schematic illustration of the arrangement on a larger scale.
Figure 3:
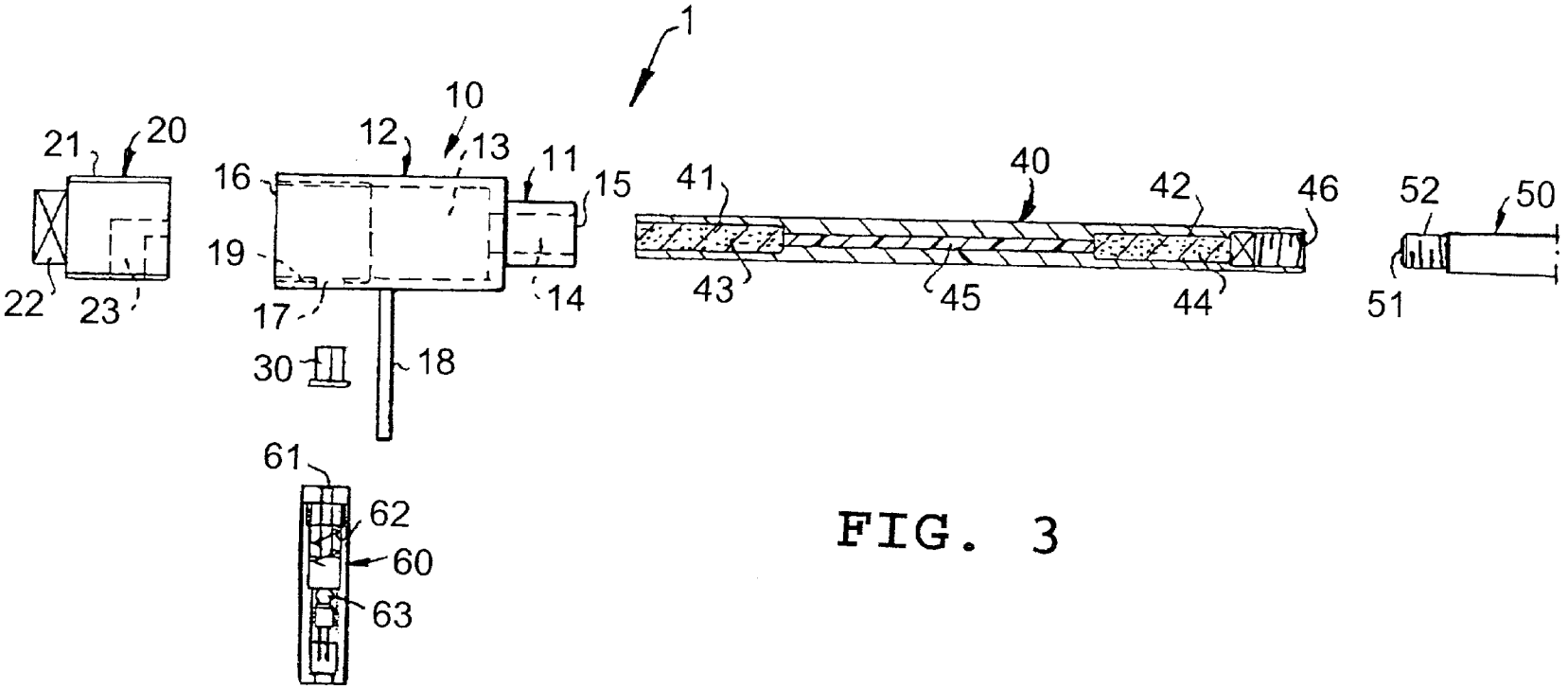
FIG. 3 is an exploded schematic view of said arrangement.

The inventive arrangement 1 also includes a so-called burst tube 40 which is shaped and sized to fit into the barrel 104 of the weapon 100, as evident from FIGS. 1 and 2. The burst tube 40 has an inner, rear cavity 41 and an inner, front cavity 42 which are filled respectively with an explosive substance or device 43, 44, such as pentyl or the like. Disposed within the tube 40 is, e.g., a pentyl fuse 45 which establishes communication between the two explosive substances or devices 43 and 44. The front end of the tube 40 includes an internal thread 46 which receives an external thread 52 on the rear end 51 of a fixing pin 50, therewith enabling the pin to be screwed into the tube 40. The length of the pin 50 is such that said pin will project beyond the muzzle of the barrel 104 when the inventive arrangement is mounted in the weapon 100, therewith enabling the front end 53 of the pin 50 to be anchored in some desired way relative to the weapon and/or its surroundings.

The inventive arrangement 1 also includes a striking or firing pin arrangement 60 that includes a firing pin 61 which is held in a rearward/inactive position by means of a compression spring 62. The firing pin arrangement 60 includes an electrically activated explosive charge 63 which communicates, via an electric igniter wire 64, with a firing device 70 which is adapted to deliver an electric signal that activates the explosive charge 63 when necessary, therewith driving the firing pin 61 against the detonator 30 and therewith cause the detonator 30 to fire the explosive charges/explosive devices 43–45.

The firing pin arrangement 60 and the detonator means 70 are preferably incorporated in a dummy magazine 80, so as to minimize the possibilities of manipulating the arrangement.

The firing device 70 will normally receive its activating signal through the medium of an alarm circuit 90 provided, for instance, in a protective housing in the form of a weapon case (not shown) or the like. The fixing pin 50 may include a pivot means 54 which enables the pin to be pivotally mounted in the weapon case or bag, and the dummy magazine 80 may be anchored firmly inside the case or bag.

The inventive arrangement 1 is fitted to a weapon 100 in the following way.

The detonator 30 is fitted to the expander 10, which includes the sleeves 11 and 12 and the end plug 20 screwed into the rear part of the sleeve 12. The expander 10 and the detonator 30 attached thereto are then positioned in the breechblock box 101. The breechblock 105 is then brought into abutment with the screw head 22, so as to hold the expander 10 in position, wherewith the sleeve 11 is guided into the chamber 102 of said weapon. The burst tube 40 is then inserted into the barrel 104 of the weapon, with the aid of the fixing pin 50 screwed to the burst tube 40, so that the explosive charge 43 will be located within the internal space 13 of the expander 10 and so that the explosive charge 44 will be positioned in the barrel 104 of the weapon. The dummy magazine 80, with the firing pin arrangement 60 and detonator 70 attached thereto, is then fixed to the weapon 100, with the firing pin 61 located close to the detonator 30. The detonator arrangement 70 is then connected to a suitable alarm circuit 90. FIGS. 1 and 2 illustrate the inventive arrangement 1 fitted in a weapon 100.

When an alarm is triggered in response, e.g., to an attempt to steal the weapon, the alarm circuit 90 will activate the detonator arrangement 70 so that an electric signal will be produced and activates the explosive charge 63 to drive the firing pin 61 against the detonator 30 which, in turn, fires the explosive charges/explosive devices 43–45. The forces generated by the explosive charge 43 deform the expander 10 and destroy the breechblock box 101 and those parts of the weapon surrounding the breechblock, while the forces generated by the explosive charge 44 deform the barrel 104, therewith rendering the weapon 100 useless.

When a weapon which has been alarmed in accordance with the invention is removed by an authorized person, the alarm is first deactivated and the weapon then separated from the dummy magazine 80 prior to removing the fixing pin 50 and its connected burst tube 40 from the weapon. The expander 10 and its connected detonator or percussion cap 30 are then removed from the weapon, whereafter the breechblock 105 can again take its forward end position.

It will be noted that the inventive arrangement 1 is very safe to handle, since the component parts of the arrangement are separated safely with regard to accidents, since the dummy magazine 80 and the firing arrangement 70 and firing pin arrangement 60 connected to said dummy magazine are first removed from the weapon before dismantling other component parts. The firing arrangement 70 is well protected inside the dummy magazine 80. Unauthorized attempts to deactivate the alarm, for instance by shooting the inventive arrangement to pieces, will also result in destruction of the weapon.

In a simplified embodiment, the explosive charge 44 and the pentyl fuse 45 can be omitted and solely the explosive charge 43 in the expander 10 retained. In this case, the burst tube 40 and the fixing pin 50 can be excluded if desired, and the explosive charge 43 placed directly inside the space 13 of the expander 10 and the opening 15 sealed-off. In the case of the simplified embodiment, the forces generated by the explosive charge 43 will primarily deform the front part of the breechblock box 101. The chamber 102 and the rear part of the barrel 104 will also be deformed to some extent.

In a further simplified embodiment of the invention, the detonator or firing cap 30, the firing pin arrangement 60 and the detonator arrangement 70 can be excluded and replaced with an electric detonator mounted directly in the passageway 23, in which case the alarm loop 90 is connected to the electric firing device just mentioned.

Although not shown, the air passageway 23 may include a branch in the form of a small subsidiary passageway which opens out adjacent the firing pin in the breechblock. This will channel a part of the explosive force in the expander 10 towards the breechblock 105 so as to damage or destroy the same. Damage to the breechblock can be amplified, by mounting in the subsidiary passageway a hardmetal pin or the like that is capable of penetrating the breechblock. The subsidiary passageway may also be provided with a separate explosive charge, so as to further ensure destruction of the breechblock.

The expander 10 and the burst tube 40 are conveniently made of steel or some other suitable metal, so that the surrounding parts of the weapon will be fused together in the explosion. Various types of explosive may, of course, be used in conjunction with the present invention.

It will be understood that the design of the inventive arrangement can be varied within wide limits, for instance by substituting the described components with functionally equivalent components.

It will also be understood that the invention is not restricted to the described and illustrated embodiments, and that changes and modifications can be made within the scope of the following Claims.

Some examples of security systems or locking devices to prevent unauthorized use of a firearm which could possibly be utilized or adapted for use in one embodiment of the present invention can be found in the following U.S. Pat. No. 5,664,358, issued on Sep. 9, 1997 to inventors Haber, et al.; U.S. Pat. No. 5,548,915, issued on Aug. 27, 1996 to inventors Szarmach, et al.; U.S. Pat. No. 5,487,234, issued on Jan. 30, 1996 to inventor Dragon; U.S. Pat. No. 5,459,957, issued on Oct. 24, 1995 to inventor Winer; U.S. Pat. No. 5,450,685, issued on Sep. 19, 1995 to inventor Peterson; U.S. Pat. No. 5,171,924, issued on Dec. 15, 1992 to inventors Honey, et al.; U.S. Pat. No. 5,016,377, issued on May 21, 1991 to inventor Gunning; U.S. Pat. No. 4,672,763, issued on Jun. 16, 1987 to inventor Cunningham; and U.S. Pat. No. 4,018, 339, issued on Apr. 19, 1977 to inventor Pritz.

Some examples of alarms, alarm devices, or alarm circuits which could possibly be utilized or adapted for use in one embodiment of the present invention can be found in the following U.S. Pat. No. 5,831,531, issued on Nov. 3, 1998 to inventor Tuttle; U.S. Pat. No. 5,775,235, issued on Jul. 7, 1998 to inventors Lindskog, et al.; U.S. Pat. No. 5,686,909, issued on Nov. 11, 1997 to inventor Steinhauser; U.S. Pat. No. 5,554,833, issued on Sep. 10, 1996 to inventor Johnson; U.S. Pat. No. 5,548,915, issued on Aug. 27, 1996 to inventors Szarmach, et al.; U.S. Pat. No. 5,191,314, issued on Mar. 2, 1993 to inventors Ackerman, et al.; U.S. Pat. No. 4,300,130, issued on Nov. 10, 1981 to inventors Fotheringham, et al.; and U.S. Pat. No. 3,967,239, issued on Jun. 29, 1976 to inventor Steele.

Some examples of explosive devices or explosive substances which could possibly be utilized or adapted for use in one embodiment of the present invention can be found in the following U.S. Pat. No. 5,775,235, issued on Jul. 7, 1998 to inventors Lindskog, et al.; U.S. Pat. No. 5,600,086, issued on Feb. 4, 1997 to inventor Lemmonier; U.S. Pat. No. 5,505,631, issued on Apr. 9, 1996 to inventors Schauer, et al.; U.S. Pat. No. 5,503,077, issued on Apr. 2, 1996 to inventor Motley; U.S. Pat. No. 5,485,788, issued on Jan. 23, 1996 to inventor Corney; and U.S. Pat. No. 5,035,843, issued on Jul. 30, 1991 to inventor Schmid.

The corresponding foreign and international patent publication applications, namely, Swedish Patent Application No. 9800852-7, filed on Mar. 15, 1998, having inventors Magnus Lindskog and Kjell Lindskog, and Laid-open Swedish Patent Application No. 9800852-7, if any, and Published Swedish Patent Application No. 9800852-7, if any, and International Application No. PCT/SE98/00378, filed on Mar. 11, 1999, and WO 99/47878, as well as their published equivalents, and other equivalents or corresponding applications, if any, in corresponding cases in Sweden and elsewhere, and the references cited in any of the documents cited herein, are hereby incorporated by reference as if set forth in their entirety herein.

The following foreign and international patent publication applications, namely, Swedish Patent Application No. 9602731.3, filed on Jul. 10, 1996, having inventors Kjell Lindskog and Ola Fristrom, and Laid-open Swedish Patent Application No. 9602731.3, if any, and Published Swedish Patent Application No. 9602731.3, if any, and International Application No. PCT/SE97/01236, filed on Jul. 6, 1997, and WO/98/01716, as well as their published equivalents, and other equivalents or corresponding applications, if any, in corresponding cases in Sweden and elsewhere, and the references cited in any of the documents cited herein, are hereby incorporated by reference as if set forth in their entirety herein.

The following foreign patent publications are hereby incorporated by reference as if set forth in their entirety herein as follows: Sweden 506749C2, published on Feb. 9, 1998; Sweden 506750C2, published on Feb. 9, 1998; Sweden 503762C2, published on Aug. 26, 1996; French 2635581, published on Feb. 23, 1990; International WO 9801715, published on Jan. 15, 1998; International WO 9801716, published on Jan. 15, 1998; International WO 9206345, published on Apr. 16, 1992; International WO 9628704, published on Sep. 19, 1996; Denmark 9400151, published on Jul. 8, 1994; and Austria 41,209, published on Feb. 25, 1910.

The following U.S. Patent publications are hereby incorporated by reference as if set forth in their entirety herein as follows: U.S. Pat. No. 5,309,842, issued on May 10, 1994 to Matysik, et al.; U.S. Pat. No. 3,973,498, issued on Aug. 10, 1976 to Persson; U.S. Pat. No. 4,681,038, issued on Jul. 21, 1987 to Washburn; U.S. Pat. No. 4,442,619, issued on Apr. 17, 1984 to McCarley; and U.S. Pat. No. 3,060,855, issued on Oct. 30, 1962 to Henning, et al.

The components disclosed in the various publications, disclosed or incorporated by reference herein, may be used in the embodiments of the present invention, as well as, equivalents thereof.

The appended drawings in their entirety, including all dimensions, proportions and/or shapes in at least one embodiment of the invention, are accurate and are hereby included by reference into this specification.

All, or substantially all, of the components and methods of the various embodiments may be used with at least one embodiment or all of the embodiments, it more than one embodiment is described herein.

All of the patents, patent applications and publications recited herein, and in the Declaration attached hereto, are hereby incorporated by reference as if set forth in their entirety herein.

The details in the patents, patent applications and publications may be considered to be incorporable, at applicants' option, into the claims during prosecution as further limitations in the claims to patentably distinguish any amended claims from any applied prior art.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents but also equivalent structures.

The invention as described hereinabove in the context of the preferred embodiments is not to be taken as limited to all of the provided details thereof, since modifications and variations thereof may be made without departing from the spirit and scope of the invention.

What is claimed is:

1. A combination of a weapon and an arrangement for rendering said weapon unusable in the event of unauthorized appropriation, said weapon comprising a breechblock and a breechblock box, and said arrangement comprising:

an expander comprising a cavity;

said expander being disposed in said breechblock box of said weapon;

an explosive substance being disposed in said expander cavity;

a firing pin arrangement; and a detonating arrangement.

2. The combination according to claim 1, wherein:

said expander comprises a surrounding wall disposed adjacent said explosive substance; and said wall of said expander is configured and disposed to be deformed by an explosion of said explosive substance to deform said expander and said breechblock box.

3. The combination according to claim 2, wherein:

said weapon further comprises a chamber; and said expander comprises a front sleeve part configured and disposed to fit snugly in said chamber.

4. The combination according to claim 3, wherein:

said weapon further comprises a magazine holder;

said arrangement further comprises a dummy magazine disposed in said magazine holder; and said firing pin arrangement and said detonating arrangement are disposed in said dummy magazine.

5. The combination according to claim 4, wherein said arrangement further comprises:

a burst tube; and a fixing pin.

6. The combination according to claim 5, wherein:

said expander comprises an end plug;

said end plug comprises an opening;

said arrangement further comprises a firing device; and said firing device is disposed in said opening.

7. The combination according to claim 6, wherein said firing device comprises one of:

a detonator; and a percussion cap.

8. The combination according to claim 1 wherein:

said weapon further comprises a chamber; and said expander comprises a front sleeve part configured and disposed to fit snugly in said chamber.

9. The combination according to claim 8, wherein:

said weapon further comprises a magazine holder;

said arrangement further comprises a dummy magazine disposed in said magazine holder; and said firing pin arrangement and said detonating arrangement are disposed in said dummy magazine.

10. The combination according to claim 9, wherein said arrangement further comprises:

a burst tube; and a fixing pin.

11. The combination according to claim 10, wherein:

said expander comprises an end plug;

said end plug comprises an opening;

said arrangement further comprises a firing device; and said firing device is disposed in said opening.

12. The combination according to claim 11, wherein said firing device comprises one of:

a detonator; and a percussion cap.

13. The combination according to claim 1, wherein said arrangement further comprises:

a burst tube; and a fixing pin.

14. The combination according to claim 1, wherein:

said expander comprises an end plug;

said end plug comprises an opening;

said arrangement further comprises a firing device; and said firing device is disposed in said opening.

15. The combination according to claim 14, wherein said firing device comprises one of:

a detonator; and a percussion cap.

16. A method of rendering a weapon that includes a breechblock useless in the event of unauthorized appropriation, said method comprising the steps of:

placing an expander in a breechblock box of said weapon;

causing said expander to be deformed with the aid of an explosive substance so as to render said weapon useless in response to an alarm being triggered; and using a firing pin arrangement and a detonating arrangement for activation of said explosive substance in response to said alarm being triggered.

* * * * *